US005193567A

United States Patent [19]

Razny, Jr.

[11] Patent Number: 5,193,567

[45] Date of Patent: Mar. 16, 1993

[54] MOBILITY ENHANCEMENT DEVICE

[76] Inventor: Frank R. Razny, Jr., 602H Jackson Rd., Shavertown, Pa. 18708

[21] Appl. No.: 783,981

[22] Filed: Oct. 29, 1991

[51] Int. Cl.[5] ..... A61H 3/02

[52] U.S. Cl. ..... 135/68; 135/71

[58] Field of Search ..... 135/65, 66, 68, 69, 135/71, 72; 280/819

[56] References Cited

U.S. PATENT DOCUMENTS

| | | | |
|---|---|---|---|
| 143,248 | 9/1873 | Pevey . | |
| 679,468 | 7/1901 | Pratt . | |
| 1,547,046 | 7/1925 | King | 135/' |
| 2,388,778 | 11/1945 | Wheeler | 135/68 |
| 2,453,742 | 11/1948 | Bowen et al. | 135/53 |
| 2,575,681 | 11/1951 | Peters | 135/68 |
| 2,817,348 | 12/1957 | Holliday, Jr. | 135/69 X |
| 2,910,995 | 11/1959 | Jacuzzi | 135/62 |
| 3,133,551 | 5/1964 | Murcott | 135/50 |
| 4,237,915 | 12/1980 | Zabielski et al. | 135/68 |
| 4,787,405 | 11/1988 | Karwoski | 135/66 |
| 4,790,339 | 12/1988 | Bennett . | |
| 4,869,280 | 9/1989 | Ewing | 135/69 |

FOREIGN PATENT DOCUMENTS

| | | | |
|---|---|---|---|
| 927264 | 10/1947 | France | 135/71 |

OTHER PUBLICATIONS

Sunrise Medical, "Guardian" Advertising brochure for walking aids.

"Walk-Aids" Advertising brochure for walking aids.

*Primary Examiner*—Richard E. Chilcot, Jr.

*Assistant Examiner*—Lan M. Mai

*Attorney, Agent, or Firm*—Nies, Kurz, Bergert & Tamburro

[57] ABSTRACT

A novel mobility enhancement device such as a crutch instructed in one piece from tubular metal, such as titanium, suitably bent to form a forearm and hand support assembly by which the weight of the user is applied directly down onto a vertical shaft. A pair of these novel crutches formed in right hand and left hand fashion enable a person with severely limited use of both legs to be independently mobile and confident of the strength and stability of the crutches.

10 Claims, 1 Drawing Sheet

MOBILITY ENHANCEMENT DEVICE

BACKGROUND OF THE INVENTION

This invention relates generally to mobility enhancement devices for use by persons who require a walking aid. More particularly, this invention relates to a crutch which is light weight, strong, compact and dependable and provides the user with a combination of forearm and hand support that creates greater stability and dependability for the user.

Various walking aids, such as forearm crutches, underarm crutches, walking canes, and quad canes are commonly used by persons who require assistance in walking. However, quite often these tend to be bulky and clumsy in construction, difficult to maneuver, lacking in strength, and generally inadequate for use by persons with severely limited use of both legs.

In addition a general purpose stick such as that disclosed in U.S. Pat. No. 4,790,339 has been proposed for multiple uses including use as a walking stick. However, a stick of this design fails to provide the support, stability and comfort necessary for use by a person having severely limited use of his legs.

SUMMARY OF THE INVENTION

Accordingly, a primary object of this invention is to provide a novel mobility enhancement device or crutch suitable for use by persons who require moderate to heavy assistance to walk. The crutch includes a combined forearm and hand-support assembly joined with the upper end of a main vertical shaft.

Another object of this invention is to provide the above novel crutch which is of one-piece construction formed of light weight, strong material such as titanium tubing. The crutch has a less intrusive appearance and is more easily used in tight, crowded areas.

Still another object of the invention is to provide the above novel crutch in which the forearm and hand-support assembly includes a horizontal handle section gripped by the hand, an upper arm support section which encircles the back of the forearm below the elbow, and a vertical intermediate connecting section extending between and integrally connected to the lower handle section and the upper arm support section. This construction provides stable, dependable support against the back of the forearm and on the hand of the user and transmits the weight of the user directly down onto the vertical shaft.

Still another object of the invention is to provide two of the above novel crutches as a pair, i.e., right-hand and left-hand, to support the entire body weight of a person with severely limited use of both legs, thereby enabling that person to be independently mobile. The novel crutches are strong, stable and dependable and provide the person with the security and confidence that he may move himself about without fearing breakage of the crutches or without falling because of the unsteadiness of the crutches.

Other objects and advantages will become apparent from reading the following detailed description of the invention wherein reference is made to the accompanied drawings.

DETAILED DESCRIPTION OF THE INVENTION

Figure 1:
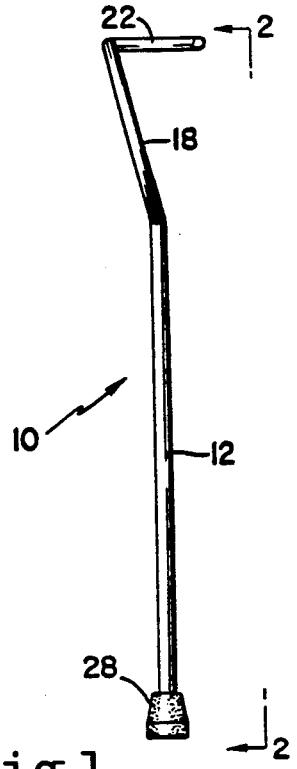
FIG. 1 is a front elevational view of the novel crutch of the invention constructed for use by the right hand.

Referring now to the drawings, the novel crutch 10 is preferably of one-piece construction made from very strong and lightweight material such as seamless titanium tubing. The size of the tubing may vary dependent upon the weight of the user. For example, for children ⅜" diameter tubing is sufficient. For adults up to 200 pounds, ⅝" diameter tubing may be used, and for heavier adults ¾" diameter tubing may be necessary.

The crutch 10 illustrated in the drawings is for use by the right hand. The tubing is suitably bent so that the crutch includes a vertical shaft 12 of a length to accommodate the height of the user and an arm and hand support assembly 14 integral with the upper end of shaft 12. Assembly 14 includes a lower horizontal handle section 16 extending forwardly from shaft 12 and joining an intermediate vertical section 18 which inclines upwardly and rearwardly of handle section 16 (FIG. 2) and outwardly to one side of section 16 (FIG. 1) away from the body of a person using the crutch. An upper horizontal arm support section 20 joins the top of section 18 and includes at its rearward end a semi-circular loop portion 22 reversely bent in the horizontal plane and open towards section 18 at the front.

Figure 2:
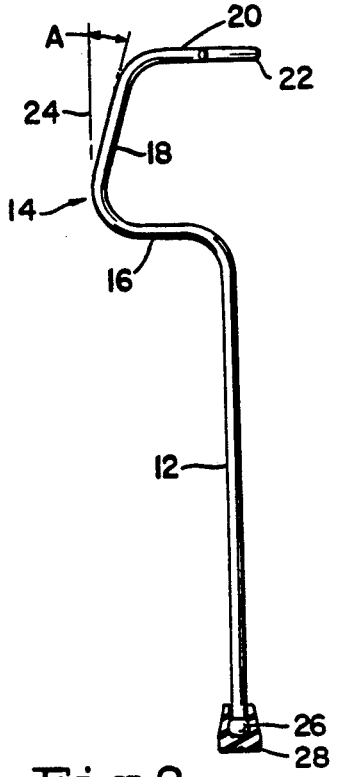
FIG. 2 is a side elevational view taken along line 2—2 of FIG. 2.
Figure 4:
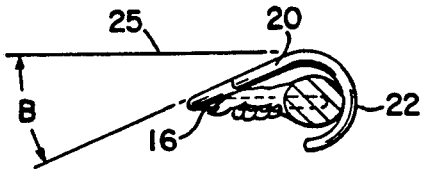
FIG. 4 is fragmentary sectional plan view taken along line 4—4 of FIG. 3.

As shown in FIG. 2, vertical section 18 inclines toward the rear at an angle A of about 15° with respect to a line 24 which is parallel to the vertical shaft 12. As shown in FIG. 1 and FIG. 4, section 18 is also bent to one side or outwardly away from the body of the user at an angle B of about 23° 30′ with respect to a line 25 parallel to horizontal handle 16. The upper surfaces of handle section 16 and arm support section 20 are substantially flat and parallel to each other, and generally perpendicular to shaft 12. The center line of the semicircular loop section 22 approximately coincides with the axis of shaft 12. Each of the tubular bends joining shaft 12 and sections 16, 18 and 20 are formed on a long radius to provide smooth, strong connecting areas.

The bottom of shaft 20 has fixed thereto a spherical ball element 26 which may rotate slightly within the crutch tip 28 so that the weight of the person is better distributed onto the tip and thence onto the walking surface.

Figure 3:
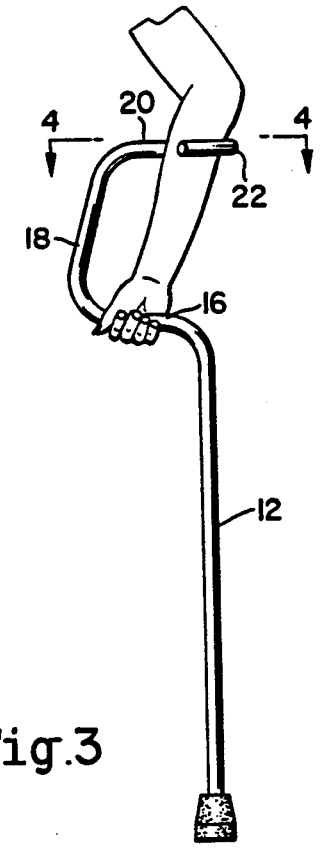
FIG. 3 is a side elevational view similar to FIG. 2 illustrating the manner in which the right hand and forearm of a person are supported on the crutch when in use.

The position of the right arm of person using the crutch is shown in FIGS. 3 and 4. The forearm below the bent elbow is nestled within loop section 22 as the right hand rests on handle section 16. The weight of the person is applied directly by the forearm below the bent elbow against loop 22, through section 16 and the arm and right hand onto handle section 16, and thence through shaft 12 and tip 28 onto the support surface. The loop section 22 acts as a leverage point to fully support the forearm which bears the weight of the person together with the hand.

The inclination of intermediate section 18 outwardly and upwardly away from the body of the user conveniently and comfortably accommodates the arm and hand of the user as shown in FIG. 4. The arm and hand are comfortably received and nestled within loop section 22 and handle section 16 close to the body without interference from section 18, and the weight of the person is directly transferred by sections 22, 18, and 16 down onto shaft 12. In addition, the inclination of section 18 outwardly away from the body leaves the area outside of the crutch smooth and clear. The end of loop section 22 is adjacent the body and no part of the crutch is exposed which might catch on objects as the person is walking. Furthermore, the intermediate section 18 is positioned in front of the hand and forearm and protects them against bumping or injury during use of the crutch.

While only a right hand crutch has been disclosed in the drawings, a left hand crutch will be constructed in the same fashion except as a mirror image of the right hand illustrated. These novel crutches will provide very stable, dependable support for a person who will move about with confidence and assurance that the crutches will support his entire weight.

The flatness of the top surface of section 20 is also beneficial. If the person simply chooses to rest, he can remove his forearms from loop section 22 and comfortably lean on the flat, smooth top surface of section 20. In this position the person has free use of his hands while still enjoying the stable and comfortable support of the crutches.

The crutches may be provided in various different size ranges to accommodate different people with the initial length of shaft 12 being oversized and then simply cut to length for a person of a particular height. Alternatively, the crutches may be custom manufactured to fit a specific person.

Although not specifically illustrated, handle section 16 and loop section 22 may be provided with handle grips and cushioning material for added comfort and security.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A crutch comprising a vertical shaft, a substantially horizontal hand support section having one end connected to said shaft and another end extending horizontally forwardly from said shaft, an upright intermediate section extending upwardly from said other end of said hand support section, a forearm support section connected to and extending substantially horizontally rearwardly from said intermediate section and including a terminal loop section which is open towards said intermediate section, whereby a person may use the crutch by placing his hand on said hand support section and engaging his forearm within and against said loop section for stable, dependable support.

2. The crutch according to claim 1, wherein said intermediate section is inclined to one side of said shaft and said loop section is generally circular.

3. The crutch according to claim 2, wherein the center line of said loop section is approximately aligned with said shaft.

4. The crutch according to claim 3, wherein said intermediate section is inclined outwardly away from the body of the person when the crutch is in use.

5. The crutch according to claim 1, wherein said hand support section and said forearm section lie in horizontal planes which are generally parallel to each other.

6. The crutch according to claim 5, wherein said planes are substantially perpendicular to said shaft.

7. The crutch according to claim 1, wherein spherical support means is mounted on the bottom of said shaft and tip means is mounted on said spherical support means.

8. The crutch according to claim 1, wherein said crutch is constructed of one-piece material suitably bent to form said hand support section, said intermediate section, and said forearm support section.

9. The crutch according to claim 8, wherein said material is tubular metal.

10. The crutch according to claim 9, wherein said metal is titanium.

* * * * *